US007658700B2

(12) United States Patent
Maloy et al.

(10) Patent No.: US 7,658,700 B2
(45) Date of Patent: Feb. 9, 2010

(54) TRAINING DEVICE FOR EXERCISING MUSCLE GROUPS OF THE ENTIRE BODY

(76) Inventors: Tate Maloy, 9751 W. Pico Blvd., Apt. E, Los Angeles, CA (US) 90035; John Lu, 999 Green St., #2602, San Francisco, CA (US) 94133

( * ) Notice: Subject to any disclaimer, the term of this patent is extended or adjusted under 35 U.S.C. 154(b) by 182 days.

(21) Appl. No.: 10/915,126

(22) Filed: Aug. 9, 2004

(65) Prior Publication Data

US 2006/0030463 A1 Feb. 9, 2006

(51) Int. Cl.
*A63B 22/16* (2006.01)
*A63B 21/055* (2006.01)
*A63B 21/068* (2006.01)

(52) U.S. Cl. ..... 482/132; 482/95; 482/123; 482/141; 482/146; 273/449

(58) Field of Classification Search ..... 482/123, 482/140, 141, 68, 126, 23, 79, 80, 125, 130, 482/132, 146, 147, 907, 34, 51, 74, 91, 92, 482/106, 142, 148, 131, 136, 95, 96, 908; 273/449; 472/114–115, 135; D21/688–689; 601/135, 129, 119, 137; 297/411.37
See application file for complete search history.

(56) References Cited

U.S. PATENT DOCUMENTS 1,721,709 A * 7/1929 Odell ..... 482/142
1,824,920 A 9/1931 Novak
2,803,461 A 8/1957 Coplin
2,829,891 A 4/1958 Ludwig
2,921,791 A * 1/1960 Berne ..... 482/118
3,024,021 A 3/1962 Coplin et al.
3,110,047 A * 11/1963 Bringman ..... 441/67
3,238,558 A * 3/1966 Greene ..... 16/35 R (Continued)

FOREIGN PATENT DOCUMENTS

DE 36 20 706 A1 12/1987

(Continued)

OTHER PUBLICATIONS

Office Action dated Mar. 30, 2007, from U.S. Appl. No. 11/378,704, filed Mar. 17, 2006, 10 pages.

(Continued)

*Primary Examiner*—Loan H Thanh
*Assistant Examiner*—Victor K Hwang
(74) *Attorney, Agent, or Firm*—Knobbe Martens Olson & Bear LLP

(57) ABSTRACT

A training and/or exercise device and method for exercising muscle groups of the entire body is disclosed herein that is portable, easy to use, can work the muscles of the entire body, and does not have complicated integrating parts when in use. The device and method allows a free range of motion about a vertical axis without substantial resistance. The device allows a wide variety of movement using a single device, and particularly allows for balancing movements that are advantageous for strengthening the core. Further, the training device is particularly advantageous for use in a home gym and may be stored under a bed or within the overhead compartment of an airplane.

20 Claims, 5 Drawing Sheets

U.S. PATENT DOCUMENTS

| | | | | | |
|---|---|---|---|---|---|
| 3,298,687 | A | * | 1/1967 | Douglas | 482/132 |
| 3,467,381 | A | * | 9/1969 | Kreiss | 473/511 |
| 3,604,726 | A | | 9/1971 | Tracy | |
| 3,947,023 | A | * | 3/1976 | Martin | 482/142 |
| 4,126,326 | A | * | 11/1978 | Phillips | 280/205 |
| 4,191,371 | A | | 3/1980 | Armer, Jr. | |
| 4,257,591 | A | | 3/1981 | Evans | |
| 4,277,062 | A | * | 7/1981 | Lawrence | 482/131 |
| 4,491,318 | A | | 1/1985 | Francke | |
| 4,601,469 | A | | 7/1986 | Sasser | |
| 4,618,143 | A | | 10/1986 | Twardosz | |
| 4,743,018 | A | * | 5/1988 | Eckler | 482/106 |
| 5,328,421 | A | | 7/1994 | Stanalajczo | |
| D353,640 | S | * | 12/1994 | Huang | D21/689 |
| 5,405,306 | A | * | 4/1995 | Goldsmith et al. | 482/120 |
| 5,421,800 | A | * | 6/1995 | Mullen | 482/121 |
| 5,549,536 | A | | 8/1996 | Clark | |
| 5,643,154 | A | | 7/1997 | Awbrey et al. | |
| D382,609 | S | | 8/1997 | Szabo et al. | |
| 5,713,823 | A | * | 2/1998 | Walendzak et al. | 482/142 |
| 5,730,690 | A | * | 3/1998 | Guidry | 482/146 |
| 5,755,650 | A | * | 5/1998 | Urso | 482/138 |
| 5,897,474 | A | * | 4/1999 | Romero | 482/146 |
| 5,921,901 | A | | 7/1999 | Palacios | |
| 6,013,010 | A | * | 1/2000 | Farsaie | 482/46 |
| 6,120,423 | A | * | 9/2000 | Mackey et al. | 482/121 |
| 6,190,292 | B1 | * | 2/2001 | Panes | 482/93 |
| 6,220,995 | B1 | * | 4/2001 | Chen | 482/140 |
| 6,244,999 | B1 | * | 6/2001 | Alessandri | 482/142 |
| 6,296,313 | B1 | * | 10/2001 | Wu | 297/411.35 |
| 6,315,695 | B1 | * | 11/2001 | Follett et al. | 482/34 |
| 6,338,702 | B1 | * | 1/2002 | Jordan | 482/108 |
| 6,338,703 | B1 | * | 1/2002 | Yu | 482/132 |
| 6,419,586 | B1 | * | 7/2002 | Chiu | 472/25 |
| 6,450,928 | B1 | | 9/2002 | Larkins | |
| 6,461,285 | B1 | * | 10/2002 | Theunissen et al. | 482/146 |
| D479,289 | S | | 9/2003 | Turner | |
| 6,626,807 | B1 | | 9/2003 | Richmond | |
| 6,638,201 | B1 | | 10/2003 | Dischler | |
| 6,676,579 | B1 | * | 1/2004 | Lin | 482/146 |
| 6,688,690 | B2 | * | 2/2004 | Watson et al. | 297/316 |
| 6,773,379 | B1 | | 8/2004 | Bing | |
| D507,026 | S | * | 7/2005 | Chen | D21/671 |
| 6,945,920 | B1 | * | 9/2005 | Kemery et al. | 482/146 |
| 7,052,449 | B2 | * | 5/2006 | Chen | 482/146 |
| 2001/0016544 | A1 | | 8/2001 | McKechnie et al. | |
| 2002/0077231 | A1 | * | 6/2002 | Dalebout et al. | 482/146 |
| 2003/0125173 | A1 | | 7/2003 | Fan | |
| 2003/0158023 | A1 | * | 8/2003 | Yu | 482/126 |
| 2003/0181300 | A1 | | 9/2003 | Chin | |
| 2004/0014571 | A1 | | 1/2004 | Haynes | |
| 2004/0087421 | A1 | * | 5/2004 | Lin | 482/146 |
| 2005/0143232 | A1 | * | 6/2005 | Hung | 482/126 |

FOREIGN PATENT DOCUMENTS

| | | | | |
|---|---|---|---|---|
| GB | 2048694 | A | * | 12/1980 |
| JP | 10290845 | A | | 2/1999 |
| RU | 2048154 | C1 | * | 11/1995 |
| WO | WO 94/08664 | | | 4/1994 |

OTHER PUBLICATIONS

Office Action dated Sep. 17, 2007, from U.S. Appl. No. 11/378,704, filed Mar. 17, 2006, 6 pages.

Office Action dated Dec. 18, 2007, from U.S. Appl. No. 11/378,704, filed Mar. 17, 2006, 7 pages.

Non-final Office Action in U.S. Appl. No. 11/378,704, dated Jul. 25, 2008.

Body Dome, from Bodytrends.com Health and Fitness Products, 2 pgs, printed Feb. 2, 2005 http://www.bodytrends.com/products/ball/bodydome.htm.

"Push-Up with Sissel Extreme balance Board and SitFits," Sissel-Online.com exercises, 1 p., printed Sep. 8, 2003, http://www.sissel-online.com/exercise/push _up_with_extreme_balance_board_and_sitfits.php.

"Push Up Balance Challenge", Novel Products Incorporated, 1p., printed Sep. 8, 2003, http://novelproductsinc.com/Merchant2/merchant.mv?Screen=PROD&Store_Code=novel&Product_Code=26157&Category_Code=Fitness_Testing.

* cited by examiner

TRAINING DEVICE FOR EXERCISING MUSCLE GROUPS OF THE ENTIRE BODY

FIELD OF THE INVENTION

The present invention relates generally to a training device and method for exercising muscle groups of the entire body. More specifically, the device and method allow a wide variety of movement using a single device that involves balancing on a base.

BACKGROUND OF THE INVENTION

There are many different activities in daily life that require an individual to use strength, agility, and balance. Further, it is more clear now than ever that a balanced exercise program of strength training, stretching and cardiovascular conditioning is the best way to ensure a healthy and active life through an advanced age. Despite having less and less time to do so, the average person, as well as the professional athlete, is using trainers and more advanced equipment to allow them to experience a more efficient, safe workout. Furthermore, in our modern world, the types of sports and training required for those sports have advanced at a very rapid pace.

A wide variety of exercise devices are available in the market that strengthen specific parts of the body. For example, a number of devices exist that strengthen the upper body using rotation, twisting of the body, weight, resistance, or balance. In addition, a number of exercise devices are available for working the lower body using rotation, twisting of the body, weight, resistance, or balance. However, most devices are used only for a specific part of the body and/or allow for only one of the methods of training. Thus, to work as many muscles of the body as possible, one would have to employ a number of different devices or use an expensive, cumbersome device.

For example, one currently popular exercise platform allows one to strengthen a wide variety of muscles of the body, but is a heavy, cumbersome device with complicated integrating parts. This makes it somewhat expensive. Further, one can only achieve a certain amount of balance training. Likewise there are numerous portable and relatively inexpensive devices available, but they generally are very limited in the exercises they permit, and the muscle groups they can effectively involve in a workout.

SUMMARY OF THE INVENTION

One embodiment is an exercise device, having a platform having an upper surface and a lower surface, a base extending downward from the lower surface of the platform that permits rotation of the platform about a vertical axis, at least two arms extendable from the platform, and at least one user-contacting portion on each arm.

In one aspect, the base is configured to pivot with respect to a support surface that the device rests on. In a further aspect, the base permits unlimited rotation of the platform. The base can be integral with the platform. Alternatively, the base is modularly attachable to the platform. The base may be any shape which allows rotation and/or pivoting, including generally hemispheric, generally conical, and having a roller. In a further aspect, the base can be positioned in a center of the lower surface of the platform.

In a further aspect, the arms can be integral with the platform. Alternatively, the arms can be modularly attachable to the platform. The exercise device may also include a length adjustment mechanism for the arms.

In one aspect the user-contacting portion includes a hand grip member. In a further aspect, the hand grip member permits adjustment. The hand grip member may rotate to various positions of the hand grip. The rotation may be permitted through at least 360 degrees. In one aspect, the rotation is substantially without resistance.

A further embodiment is an exercise device in which there is no lateral inhibitor of motion as part of the base. In one aspect there are no lateral elements in contact with the base.

A further embodiment is an exercise device in which there are no interarticulating parts.

A further embodiment is an exercise device in which has at least one notch on a perimeter of the device. The at least one notch can be configured for articulation with a modular attachment. The modular attachment can provide resistance in at least one direction. In one aspect, the resistance is at an angle above the perimeter of the device. In a further aspect, the angle is between 10 and 180 degrees. In a further aspect, the resistance is at least one removable strength band. Alternatively, there are two removable strength bands of at least two resistances. In one aspect the strength band has a means for length adjustment. In one aspect, the at least one strength band is configured to articulate with at least one notch on a perimeter of the platform.

A further embodiment is an exercise device in which the base is composed of a substantially inflexible material.

A further embodiment is an exercise device, having a platform having an upper surface and a lower surface, a base extending downward from the lower surface of the platform, that permits rotation of the platform, the base configured to pivot with respect to a support surface that the device rests on and wherein the only impediment to pivoting of the base with respect to the support surface is contact between the platform and the support surface, at least two arms extendable from the platform, and at least one user-contacting portion on each arm. In one embodiment, when in use, there are no interarticulating parts.

One embodiment is an exercise device, having a platform having an upper surface and a lower surface, a base extending downward from the lower surface of the platform, that permits rotation of the platform about a generally vertical axis when the device rests on the support surface and partially supports the weight of a user and wherein said base is composed of a substantially inflexible material, at least two arms extendable from the platform, and at least one user-contacting portion on each arm.

A further embodiment is an exercise device, having, a platform having an upper surface and a lower surface, a base extending downward from the lower surface of the platform, that permits rotation of the platform, the base configured to pivot with respect to a support surface that the device rests on and wherein said base comprises a roller, at least two arms extendable from the platform, and at least one user-contacting portion on each arm.

A further embodiment is an exercise method for strength and flexibility, including the steps of contacting the device of claim 1 and moving through an angle in cooperation with the device.

In one aspect, the contacting results in the involvement of at least one muscle selected from the group consisting of: biceps, triceps, shoulders, gluteus, abdominals, core, quadriceps, back and hamstrings.

In a further aspect, the moving through an angle includes at least one exercise selected from the group consisting of: a single arm row, a shoulder press, a front raise, and a single arm elbow extension (also called a triceps kick-back).

A further embodiment is a method for strengthening the upper body and core, by: performing push-ups on the exercise device and in one embodiment, the user moves each separate arm forward and backward to provide a torsion to the torso.

In a further aspect, the method also includes rolling the exercise device forward and backward to activate abdominal muscles.

A further embodiment is an exercise device, having: a generally horizontal platform having an upper surface and a lower surface; a base extending downward from the lower surface of the platform, a lower surface of the base configured to roll against, and have only a single point or line of contact with, a generally flat support surface; at least two arms extendable from the platform; and at least one user-contacting portion on each arm.

In one aspect, the base is configured so that when the lower surface of the base has a single point of contact with a generally flat support surface, the base permits unlimited rotation of said device about an axis passing through said single point of contact and oriented generally perpendicular to said generally flat surface. In a further aspect, the base includes a first portion and a roller configured to freely rotate against a generally flat support surface. In a further aspect, the only impediment to rolling of the lower surface of the base against a generally flat support surface is contact between a peripheral edge of the platform with the support surface. In a further aspect, the base is formed of a substantially inflexible material.

BRIEF DESCRIPTION OF THE DRAWINGS

FIG. 4A is a hemispheric base. FIG. 4B is a conical base. FIG. 4C is a roller base.

DETAILED DESCRIPTION OF THE PREFERRED EMBODIMENT

Embodiments of a relatively inexpensive, simple, portable, exercise device are disclosed herein that can be used to strengthen the entire body, and particularly the core area of the body. In preferred embodiments, the device does not have integrating, moveable, or breakable parts when in use and requires a minimum of effort to manipulate into a workable configuration.

Preferred embodiments of training and/or exercise devices and methods for exercising muscle groups of the entire body are disclosed herein that are portable, easy to use, can work the muscles of the entire body, and do not have complicated moving/articulating parts when in use. The devices and methods allow a free range of motion about a vertical axis without substantial resistance. Preferred devices allow a wide variety of movement using a single device, and particularly allow one to incorporate balancing movements into the workout. Balancing movements are particularly advantageous for strengthening the core. Preferred training devices are particularly advantageous for use in a home gym and may be stored under a bed or within the overhead compartment of an airplane. One advantage of the preferred exercise devices is that they allow one to take a traditional exercise and to use more muscles than are typically involved in the exercise or, alternatively, to use different muscles to perform the exercise. For example, a simple push-up when performed using an embodiment of the device requires using the core muscles to stabilize the base and the less-used muscles of the arms and back when the device is rotated or pivoted. Because areas of the body that previously did not appear to be important such as the core area of the body, are now seen as key to developing strength, improved posture balance and coordination, it is of interest to work muscles that previously were not generally targeted and to work the muscles in different ways to allow for strength and flexibility.

Figure 1:
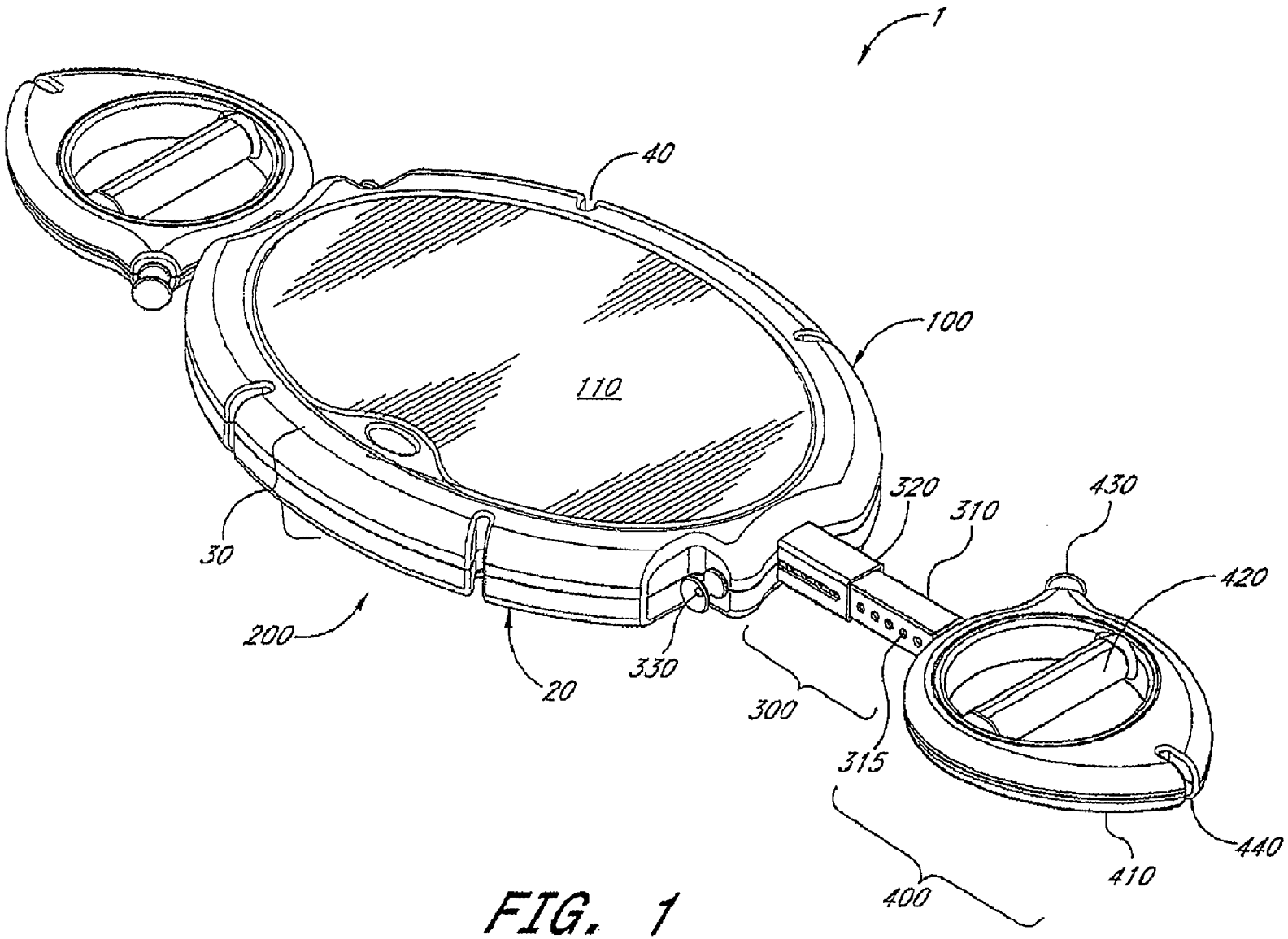
FIG. 1 shows a top perspective view of the exercise device of a preferred embodiment.

With reference initially to FIG. 1, the exemplary exercise device 1 depicted generally comprises a top 10 and a bottom 20. The top 10 is generally used for the user attachment or contact. The bottom 20 is generally used for contacting a support surface. The device generally includes a platform 100 and a base 200. The base 200 can be modular and is connected to the platform 100 to permit free rotation about a 360° angle, or beyond, about a vertical axis. In preferred embodiments, rotation is circular movement about an axis. Further, the base 200 is configured to pivot with respect to a support surface that the device rests on. The device additionally includes arms 300 and user support surfaces 400 for the user to contact when manipulating the device.

In a preferred embodiment, the device 1 does not have any additional lateral inhibitors to movement other than that of the arms 300 of the device or the user-contacting portions 400 of the device. Thus, for example, when the preferred embodiment is in use, the only point or set of points that contact the support surface is that of the base 200. Should the device 1 be rocked in any direction with respect to the support surface, the first part of the device that contacts the support surface are the arms 300 and/or user support surface 400 or the sides 30 of the platform 100. In a further preferred embodiment, the device does not have any lateral inhibitors that are part of the base 200 or in contact with the base 200. In a preferred embodiment, the base 200 is modular. By modular it is meant that bases 200 with a variety of shapes, sizes and other qualities may be attachable to, as well as detachable from, the platform 100. These bases 200 may be used in a variety of exercises. In a further preferred embodiment, the arms 300 and/or user support surfaces 400 are adjustable for size, length, and/or rotation. For example, a user support surface 400 that is a handhold can be adjusted to be perpendicular to the arms 300, parallel to the arms, or at a variety of angles to allow for a variety of hand positions during use.

In a preferred embodiment, the modular base 200 and the adjustable arms and hand grips are locked in for use and therefore, in use, the exercise device 1 does not have articulating or moving parts. Thus, the device can function as an integral device and, in preferred embodiments, integral is meant to identify that the parts act as a single unit and do not move separately during use.

With further reference to FIG. 1, the bottom 20 of the device 1 is generally the part of the device 1 that contacts a support surface. In use, this typically means that the base 200 or the bottom 20 of the platform 100 contact the support surface. The support surface can be any surface known to one of skill in the art and may depend on the type of exercise being performed. However, generally a flat, smooth surface is most preferred for allowing the balancing, pivoting, and/or rolling of the device. Examples of surfaces include, but are not limited to, a floor, a bench, a wall, a step, and a table. The device can also be used on a soft surface, such as a carpet, a mat, or the like, in cases in which it is desirable to restrict the movement of the base against the support surface and permit easier balance and provide more resistance to pivoting or rolling.

While the exercise device is generally used with the base 200 attached, in some embodiments the base 200 may be removed and the device used with a resistance band to work the muscles without the additional need to balance.

Figure 2:
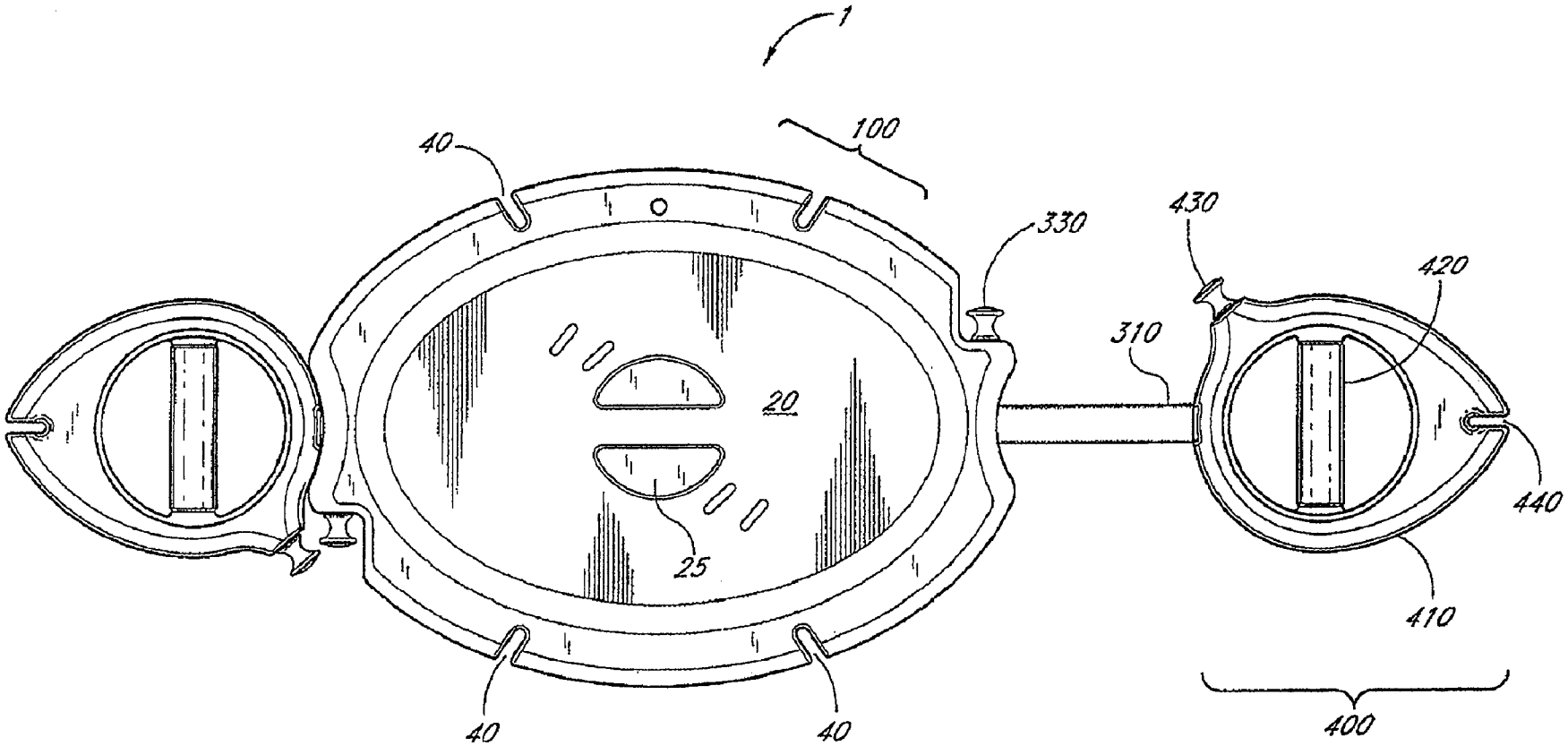
FIG. 2 shows a bottom view of the exercise device of a preferred embodiment.
Figure 3:
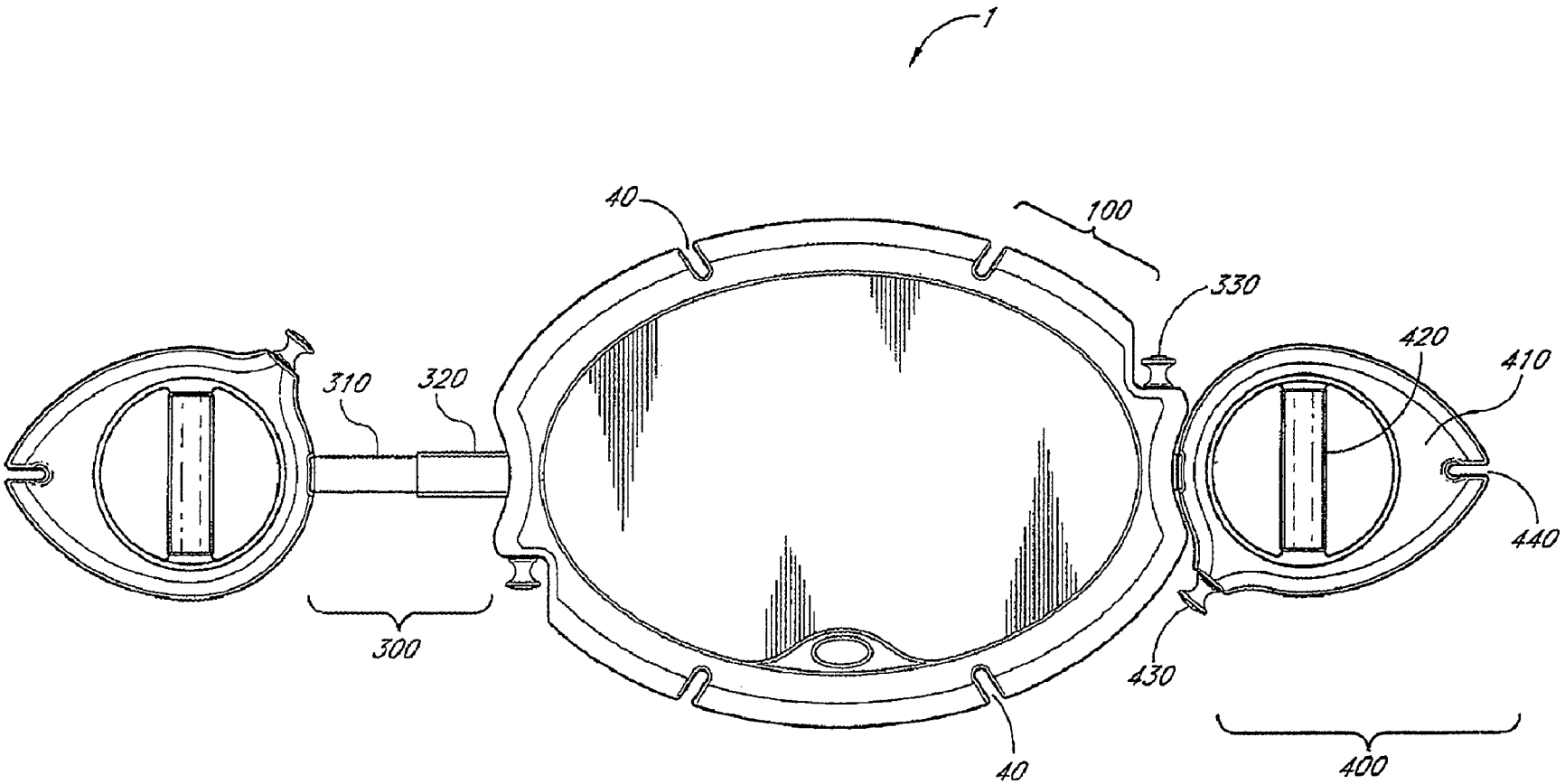
FIG. 3 shows a top view of the exercise device of a preferred embodiment.

With reference to FIGS. 1-3, the platform 100 is generally oblong or rectangularly shaped and generally comprises a top 110, a bottom 20 and sides 30. However, any shape can be employed that allows the general rotational, pivoting, and rolling and rocking movements described herein. The length of the platform is generally the distance from one arm attachment to the opposite arm attachment. In a preferred embodiment, this dimension is generally larger than the width. One preferred embodiment of the platform 100 is described in Example 1 that has a generally oval to oblong shape. This embodiment is also sized such that an average-sized human can stand on the platform if desired with his legs at hip- or shoulder-width or wider. Further, the length is sized to allow a user to perform a comfortable push-up while contacting the user-contacting portion 400 of the device with hands or forearms. Thus, the length of the platform is from about 1 foot to about 6 feet, including but not limited to, 1.5 feet, 2 feet, 2.5 feet, 2.75 feet, 3 feet, 3.25 feet, 3.5 feet, 3.75 feet, 4 feet, 4.25 feet, 4.5 feet, 4.75 feet, 5 feet, 5.25 feet, 5.5 feet, 5.75 feet, and 5.9 feet. Preferably the length of the platform is from about 2 feet to about 3.5 feet. The width of the platform is from about 1 foot to about 5 feet, including but not limited to, 1.5 feet, 2 feet, 2.5 feet, 2.75 feet, 3 feet, 3.25 feet, 3.5 feet, 3.75 feet, 4 feet, 4.25 feet, 4.5 feet, 4.75 feet, and 4.9 feet. Preferably, the width is from about 1 foot to about 2 feet.

The platform 100 may be manufactured of any material known to one of skill in the art that is generally inflexible, resistant to breakage, and durable. Preferably, the material is also lightweight to allow ease of transport of the device. Examples of materials include, wood products, metals, aluminum, plastics and plastic mixtures or composites such as Woodfibre/Plastic composites. Examples of plastics which can be used include, but are not limited to: acrylic, polystyrene, ABS, ABS/PVC, polystyrene ABS, and polycarbonate. The plastic may be shaped by any process known to one of skill in the art, including but not limited to: injection molding, thermoforming, extrusion, transfermolding, and casting. In one embodiment, the material is smooth. Alternatively, the material is not smooth and/or is treated to contain a patterned or nonslip surface. Alternatively, a nonslip material may be included. Preferably, the nonslip material or pattern is included upon the top 110 of the platform. Alternatively, a nonslip material may be included upon the bottom 20 of the platform 100 to be used when the base 200 is removed so the platform does not slip on the support surface.

In some embodiments, notches (40, 440) are included and may be located around the perimeter of the device 1 to allow a user to attach rope, rubber hosing or other type of exercise, strength or resistance band to the exercise device so as to permit exercises using the strength band. The notches 40 may be included on the platform 100 at any point along the perimeter. Alternatively, the notches 440 may be included on the user-contacting portion 400. Exercises that involve the attachment of a band to the notches 40, 440 may involve the use of the base 200 (incorporating the need to balance on the device) or may alternatively be performed after removing the base 200 to reduce the difficulty. A resistance band can include any type of band, rope or tubing that can be used to add resistance to an exercise. Many types of resistance bands and tubing are known to one of skill in the art, including but not limited to: EVERLAST PILATES™ resistance tubing, VERSATUBE™, XERTUBE™ and THERABAND™. The shape of the notches 40, 440 need only allow the attachment and removal of the resistance band. Alternatively, the resistance band may be permanently attached. It is apparent to one of skill in the art that other shapes can be used for the notches 40, 440, such as L-shaped slots. Further, rubber tubing or rope can be attached either removably or permanently to the apparatus and notches can be used simply as guides. In one embodiment, the resistance band is secured within the notch 40, 440 using any method known to one of skill in the art, including but not limited to a carabiner-type latch, a gated latch, a rubber latch, a ratcheting latch, a one-way latch, and the like.

Figure 4A:
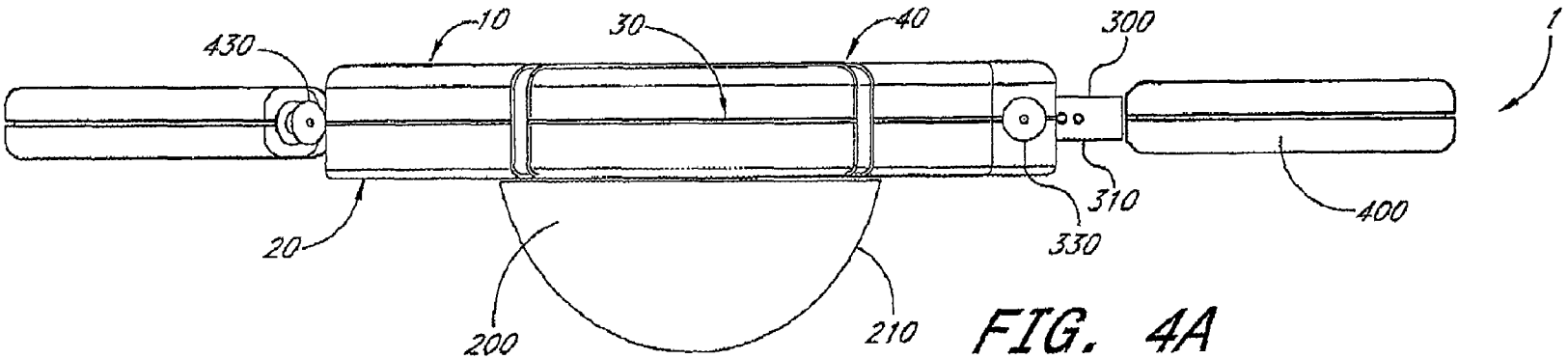
FIGS. 4A-C show side views of the exercise device of a preferred embodiment, with various preferred embodiments of the base.
Figure 4B:
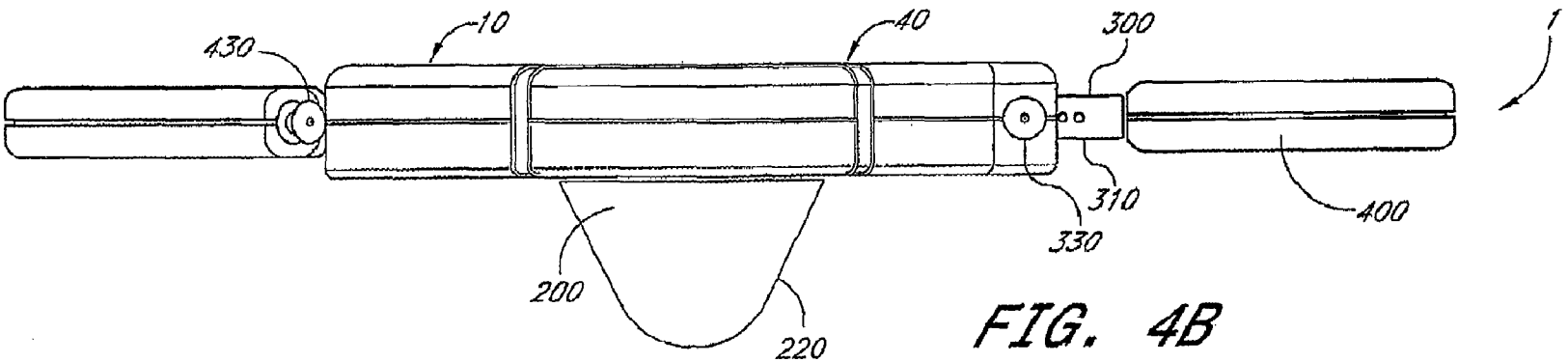
Figure 4C:
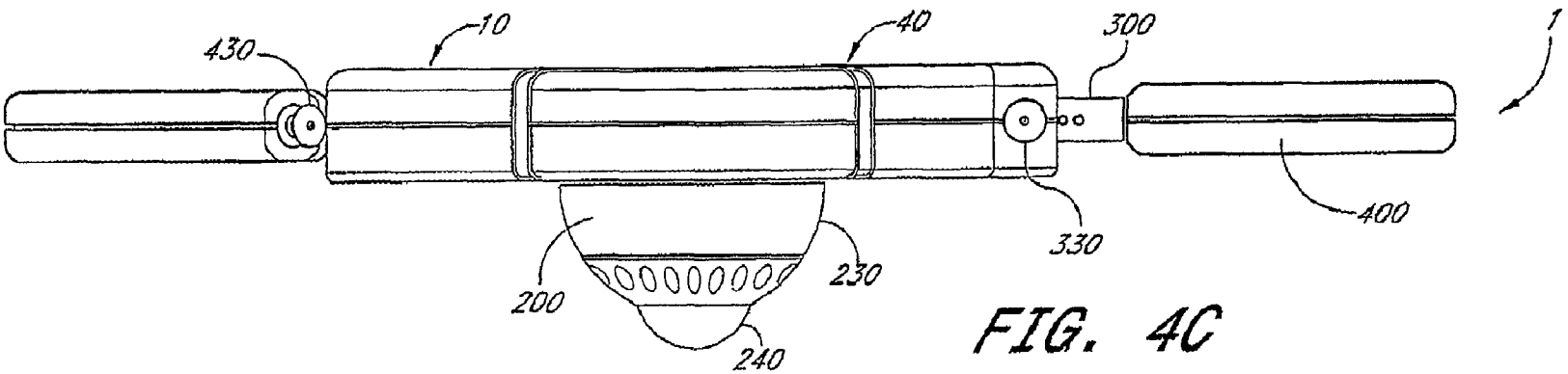

With reference to FIGS. 2 and 4, the base 200 is securely attached to the platform on the bottom 20 of the platform 100. The base 200 may be attached to be removable (modular) or may be permanently attached. In the event that the base is permanently attached, a variety of exercise devices 1 can be made available that have a variety of bases 200 attached thereto. In the case where the base 200 is removable, it is modular. In a preferred embodiment, modular means that a variety of bases 200 can be attached and removed to the platform 100. The attachment of the base 200 to the platform 100 is generally secure enough to allow a user to put his or her body weight on the device without movement of the base 200 with respect to the platform. Further, although removeable, the base itself is integral with the platform. In this context, integral means that the base does not move with respect to the platform while in use or after securing it to the platform. Integral also suggests that there are no interarticulating parts that move while the device is being used. The method and mechanism of attachment is any mechanism that allows a secure attachment, but can be easily removed and a different base 200 attached. The variety of the modular bases 200 allows for differences in the size, shape, texture, height and function. For example a base 200 that rolls is a preferred embodiment. A wide base 200 may be included that is easier to balance upon in addition to a more conical base 200 that is more difficult to balance upon (see FIGS. 4A-C).

One embodiment of the attachment of the base 200 to the platform 100 is shown in FIG. 2. In this embodiment, the attachment includes a formation 25 that allows a clamshell-type attachment at 25 which locks into place at with a ridged plastic insert. However, any type of attachment for the base can be used; preferred embodiments allow a firm and immobile connection.

With reference to FIGS. 4A-C, the base 200 may be any shape that permits rotation about a vertical axis up to 360°, or more, and that is configured to pivot with respect to a support surface that the device rests on. In one embodiment, the pivoting of the base 200 may be in any direction with respect to the support surface. In a further embodiment, the only impediment to the pivoting of the base with respect to the support surface is contact between the platform and the support surface. Thus, in this embodiment additional lateral inhibitors of motion are not included as part of the base and there are no lateral elements or components in direct contact with the base. Thus, the user provides stability during the pivoting motion and the extent of the pivoting is typically decided by the user's strength, balance and ability. In a further embodiment, the pivoting is substantially without resistance. Resistance may include, but is not limited to, external resistance, resistance due to the material of the base 200, the shape of the base 200, or the pattern of the base 200. For example, the base 200 is preferably constructed of a substantially smooth material (with little grip or pattern on it). In some embodiments, additional lateral elements may be added that allow for rocking of the device and/or a lateral impediment that is not in contact with the base 200, but may be a part of the arms 300, user-contacting portion 400 or platform 100.

In a preferred embodiment, the rotation of the base is generally unrestricted or unlimited. However, in some embodiments, the base 200 rotates through a 360° angle or less, including but not limited to an angle of 320°, 300°, 280°, 260°, 240°, 220°, 200°, 180°, 160°, 140°, 120°, 100°, 90°, 80°, 60°45°, 40°, 35°, 30°, 25°, 20°, 15°, 10°, and 5°. In one embodiment, the angle is between 10 and 180 degrees. The angle may be chosen based on the specific uses for the device. For example, if used for push-ups and push-up variations, one might want to rotate the device up to 90° to provide a variation on a push-up such that different muscles are used. For example, when the left arm is rotated 45° forward, the right arm is rotated 45° rearward and a different set of muscles is used as compared to classical push-ups. In one embodiment, the base permits unlimited rotation of the platform and, when in use, provides a minimum of resistance. Thus, the rotation of the device is substantially without resistance, including but not limited to, external resistance, resistance due to the material of the base, the shape of the base, or the pattern of the base. For example, the base is preferably constructed of a smooth material (without a grip or pattern on it). In a further embodiment, the base is generally hemispheric or rounded. In a further embodiment, the part of the base that contacts the support surface is rounded or curved. The base may be substantially hemispheric, conical, triangular, wedge-shaped, or trapezoidal and may include a rounded surface that is in contact with the support surface. In a preferred embodiment, substantially conical includes generally converging on a point, but not having a point, generally cone-shaped, and/or generally having a single point or set of points with the surface.

With reference to FIGS. 4A-4C a variety of embodiments of the base 200 are shown. In FIG. 4A, a generally hemispheric base 210 is shown. In preferred embodiments, hemispheric refers to half a sphere or a rounded shape. However, this can include things that are generally spherical or generally rounded and they need not have the shape of a perfect sphere. In preferred embodiments, hemispheric refers to generally having a single point of contact or a line of contact with a surface. The size of the hemisphere may be any size, but is generally smaller than the size of the platform 100. The base 200 shown in FIG. 4B is a generally conical base 220 and would increase the difficulty when balancing. The embodiment of the base shown in FIG. 4C is a roller base 230 and includes a roller 240.

With further reference to FIG. 4C, the roller base 230 may comprise a wheel or roller 240 that allows one to do roll outs from the knees. The wheel 240 may be any shape that allows a forward backward movement. Alternatively, the wheel or roller 240 may be any shape that allows a forward/backward and side to side movement. Alternatively, the roller 240 may allow movement in all directions from a resting point on the support surface. In some embodiments, the roller base 230 still allows rotation about the 360° angle and/or pivoting and rocking of the device 1. However, in some embodiments, the roller base 230 may not allow rotation. The roller 240 in combination with the base 230 can also be called a trackball 240. The movement with the trackball 240 allows for strengthening of the core and abdominal muscles as well as the shoulders.

While the trackball 240 is generally used as a base, attached to the platform, the device can include two trackballs 240 with hand grips that can be used in two separate hands separately from the rest of the device.

The base 200 can be manufactured of any material known to one of skill in the art. Preferably, the material is generally inflexible, unbreakable, and durable. The device can also be configured with one base that is flexible, but, generally, at least one base is included that is substantially inflexible. The base can be constructed of the same material as the platform or can be a different material. Examples of materials that can be used in the construction of the base include, but are not limited to, wood products, metals, aluminum, plastics, composites and mixture. Any of the plastics which are listed for the platform may also be used for the base. In one embodiment, the material is smooth. Alternatively, in some embodiments the material is not smooth and/or is treated to contain a patterned or nonslip surface. In a further embodiment, the base is composed of a substantially inflexible material. In some embodiments, substantially inflexible means that the material does not substantially change shape when full or partial body weight is applied. For example, when in contact with a hard surface, the material does not deform to a perceptible amount. In a further embodiment, substantially inflexible means that the amount of the base that contacts the support surface does not substantially increase when full or partial weight is applied to the device.

With further reference to FIGS. 1-3, the device 1 also includes at least two arms 300 that extend from the platform 100 or can be simply an extension of the platform 100. The arms 300 can also have user-contacting portions 400, for example, hand grip members that allow for contact with the hand, forearm or other body part of the user and, in one embodiment, allows a more comfortable grip or handhold when using the device.

With reference to FIG. 1, the arms 300 are generally integral with the platform 100 and, even when they allow for adjustment of the length, can be secured such that they will not move during use. The arms 300 can be adjustable for length and extend generally horizontally from the platform 100. The arms 300 are generally at opposite ends of the platform 100 although a curvature of the arms and/or positioning of the arms somewhat forward or backward of exactly opposite can provide some advantages for certain uses of the device.

A variety of sizes and shapes can be used for the arms 300. In one embodiment, the arms 300 are constructed separately from the platform 100. In a further embodiment, the arms 300 are constructed to be integral with the platform 100, but have a variety of hand grips at different lengths along the arm 300. In a further embodiment, the width of the arms can depend upon the construction material, but will generally be less wide than the width of the platform. The arms 300 themselves can be of a fixed length or alternatively, the arms 300 can be adjustable to a variety of lengths. This provides the user with the ability to lengthen or shorten to a desired length depending on the size of the person using the device and/or the body part that is to be strengthened. For example, to work the triceps, the arms 300 can be shortened, while to work the shoulders, the arms 300 can be lengthened. Alternatively, a larger person can move the arms 300 farther apart, while a smaller person can keep them closer. Generally, there will be a number of choices for the lengths such that the user can find the most appropriate length for the exercise or for his or her size. The length of the arms 300 is generally the distance from the attachment to the platform 100 to the attachment to the user-contacting portion 400. Thus, the length of each arm 300 can vary from being flush with the platform 100 to about 8 feet, including but not limited to 1 inch, 2 inch, 3 inches, 6 inches, 8 inches, 10 inches, 1 foot, 1.2 feet, 1.5 feet, 1.75, feet, 2 feet, 2.5 feet, 2.75 feet, 3 feet, 3.25 feet, 3.5 feet, 3.75 feet, 4 feet, 4.25 feet, 4.5 feet, 4.75 feet, 5 feet, 5.25 feet, 5.5 feet, 6 feet, 6.5 feet, 7 feet, and 7.5 feet. In a further embodiment, the length can be from about 2 inches from the platform 100 to about 4 feet, or more.

In some embodiments, the device 1 has only a single fixed arm 300 length and can be purchased in a variety of lengths, depending on the size of the user. In further embodiments, the arms 300 are moveable to a variety of lengths and securable to that length. The mechanism for moving and securing the arms 300 to the desired length can be any mechanism known to one of skill in the art. Further, the variety of lengths can be dependent upon the type of mechanism used. For example, a simple mechanism that simply secures the arm to a desired length using a pressure mechanism might allow for unlimited variation in length. In a further embodiment, the arms 300 can be removed completely. The embodiment shown in FIG. 1 contains arms 300, each including a bar 310 with holes for attachment of a casing 320 to choose and secure the arms 300 to a desired length. When the user wants to adjust the length, he or she pulls the slot bar (attached to a knob in this case) 330 to remove the slotbar 330 from the hole 315. This allows the user to adjust the length of the arms 300. The knob for the slotbar is shown attached to the platform 100. However, in other embodiments, the lock mechanism can be found on the arm itself, the user-contacting portion 400, or any other part of the device 1. The embodiment shown in FIG. 1 can allow between 2 and 100 length variations. In some embodiments, the arms have about 3 to about 50 different lengths. In further embodiments, the arms 300 are only moveable to 3 fixed lengths, for example, flush with the platform, 8 inches, and 2 feet. In a further embodiment, the arms 300 are only moveable to 30 lengths, in increments from 0 feet (flush with the platform) to 3 feet.

The arms 300 can be constructed of a variety of materials and the choice of material can depend upon the type of construction, the adjustability of the arms, and the length of the arms. In the embodiment shown in FIG. 1, the arms are preferably constructed of a material that is durable and strong enough to allow repeated movement and securing of the arms, for example metal or steel. In a further embodiment, the arms can be constructed of plastic. In a further embodiment, the arms are constructed of the same material as the platform and integral with the platform. In a further embodiment, the arms are constructed of metal and the handles are constructed of plastic.

With further reference to FIGS. 1-3, the device comprises at least one user-contacting portion 400 on each arm 300. In one embodiment, the user-contacting portion 400 is adjustable for length in addition to or in rather than the arms 400. In a preferred embodiment, the user-contacting portions 400 are advantageously constructed to be used as handholds. With reference to FIG. 3, the handholds 400 are generally constructed to have an oval shape 410 containing a hand grip 420. The hand grip 420 can be moveable up to 360° with respect to the arms 300. This advantageously allows for the user to grip the hand grips 420 with the knuckles pointing forward or alternatively, to allow for a grip with the knuckles pointing as far as 180° to each side. In one embodiment, the hand grips can be moved about a 360° angle, including but not limited to angles of: 260°, 180°, 120°, 90°, 75°, 45°, 10°, and 0°. In a further embodiment, the hand grips can be moved in a number of fixed angles. In a further embodiment, the hand grips can be adjusted to three different positions, preferably vertical, angled and horizontal. In a further embodiment, the hand grips can be moved to three different selected angles, neutral (0°), 45° and 90°. It is to be understood that once the hand grip 420 is moved to the desired angle it can be fixed by any means known to one of skill in the art. With reference to FIG. 3, in that one embodiment of the mechanism is shown, the handholds 400 comprise a knob 430 that allows the user to choose the angle for the hand grips 420. A preferred mechanism for adjustment in this embodiment is similar to the method of adjustment of the arms 300, except that hand grip 420 containing holes is rounded (encased in a plastic casing 410 in this case) and the slotbar attached to the knob 430 is found on the user-contacting portion 400. Thus, the user pulls the knob 430 to remove the slotbar and moves the hand grip 420 to the desired position, then inserts the slotbar. The ability to change the hand grips to different angles allows one to externally rotate the arm that is better for a more complete workout of the shoulder and allows for the involvement of the tricep muscle.

The user-contacting portion 400 can also contain notches 440 for the attachment of a rubber tubing or resistance band. The notches can be found anywhere along the perimeter of the user-contacting portion 400.

Figure 5:
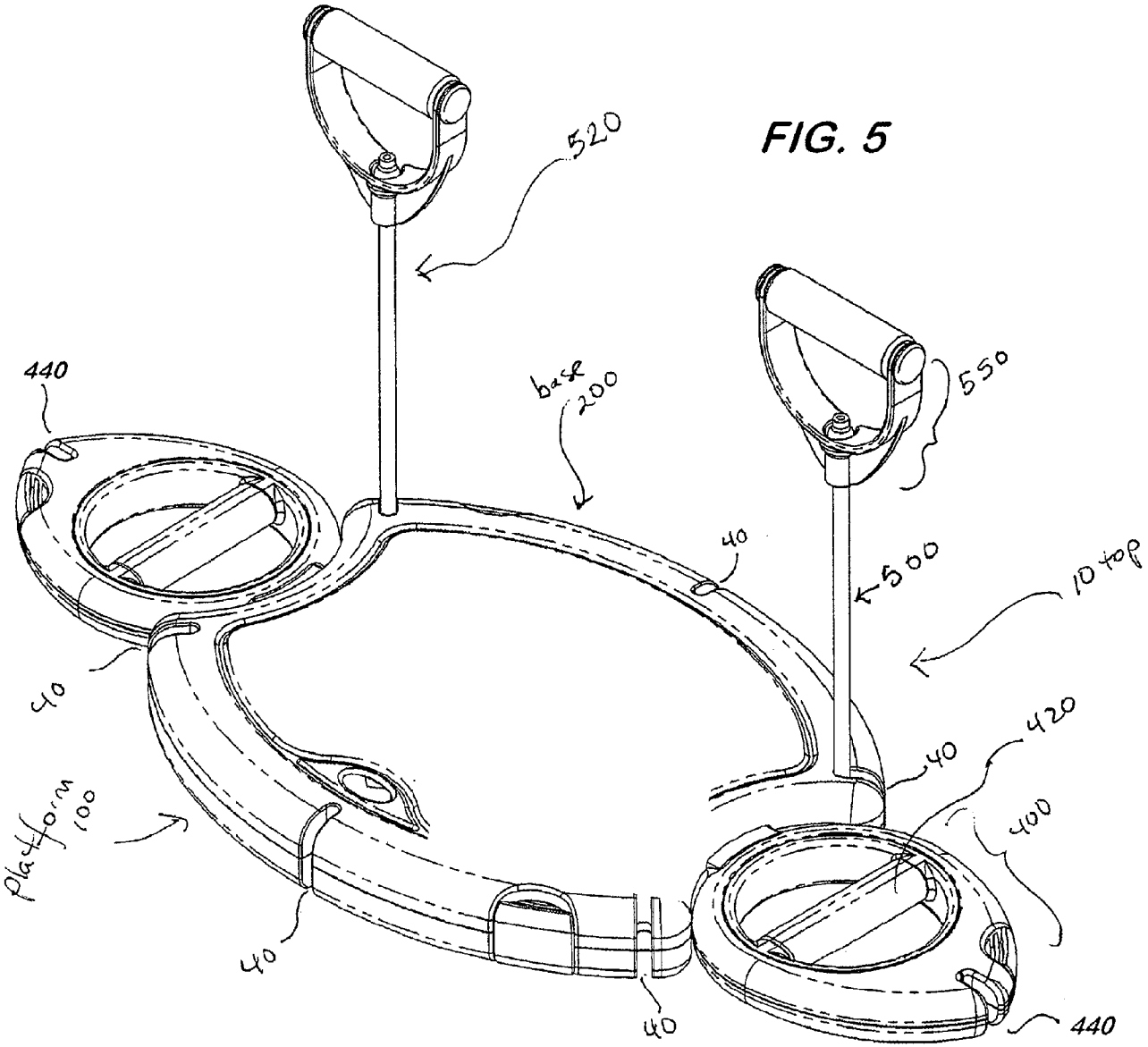
FIG. 5 shows a system using the exercise device of a preferred embodiment with a strength band.

One embodiment of the rubber tubing or resistance band is shown in FIG. 5. The resistance band system includes a resistance band 520 which comprises a band 500 and two handles 550. The resistance band is shown in FIG. 5 secured in two of the slots 40. Of course the band can be inserted into any of the slots 40 shown on the platform 100 and/or handles 400. Alternatively, the resistance bands can be fixed within the user-contacting portions 400, for example, looped over the hand grip 420. The resistance band may include a means for selecting a length. The resistance band may also include selectable marks to allow length selection to be even on both sides and/or a marker in the middle of the band to allow the user to position the band evenly. In one embodiment, three or more different resistance bands 520 of varying strength are included. In a further embodiment, two resistance bands 520, one stronger than the other are included. The bands may also be of varying length, for example about 3-5 feet unstretched. In one embodiment, the resistance bands 520 have length adjustment rings drawn on them and length adjustment means to choose the desired length. In one embodiment, the system is sold with two bands, a 10 inch band and a 25 inch band.

The resistance band 150 may be configured and obtained separately or two or more different bands may be packaged together which have varying strengths. For example, one band may be a thicker or stronger type of rubber than the other. Thus, one or more bands can be included with a system for selecting the length and/or two or more different resistance bands, of varying strength, can be packaged together. Further, the two or more different band strengths can be identified using any method known to one of skill in the art, including color coding, writing on the band or handles, and the thickness of the band (a thicker band having a stronger resistance).

The commercial embodiments of the exercise device are packaged in a variety of ways. Further, it can include a variety of removable and interchangeable pieces. For example, the device can be purchased with three alternate bases. Alternatively or in addition the device can be purchased with at least one resistance band, or with three different resistance bands of varying strength. Further, the three different band strengths can be identified using any method known to one of skill in the art, including color coding, writing on the band or handles, and the thickness of the band (a thicker band having a stronger resistance). In one embodiment, the exercise device can be purchased with two trackballs with handles that can be used separately from the exercise device or can be attachable as a base.

EXAMPLES

The design and construction of one embodiment of the exercise device is provided in Example 1. In Examples 2-5 some uses for the exercise device are provided. However, there are many uses and variations on the exercise device that can be identified by one of skill in the art, for example, a user, a trainer, or a physical therapist. Further, although the exercises are grouped into areas of the body that are worked, it is understood that an exercise that works the lower body can also be working the core and that in addition to the primary muscles being worked, secondary muscles can be worked and many muscles can be required for stabilization of the primary muscles.

Example 1

Design and Construction of One Embodiment of the Exercise Device

The majority of the exercise device is made of ABS plastic and is produced by injection molding. The arms are produced of steel which is glued onto the plastic user contacting device and the plastic platform. The three bases are constructed of a similar ABS plastic. The device is sold as one piece with three bases, and six resistance bands.

Examples 2-4 provide exercises that can be performed with or without the base. When performed with the base attached, the exercises can be performed with both legs on the platform—the maximum amount of balance training, or with only one leg on the platform—a lesser amount of balance training. In this way, even the upper body exercises can be varied to include lower body and core training. The choice of which base to use can depend upon the level of advancement of the user. For example, squats using the conical base are considerably more difficult than those using the wider hemispheric base. Further, performing push-ups using the wider base decreases the difficulty. The roller base can also be incorporated into any exercises for which it would be appropriate.

Example 2

Use of the exercise device for upper body strength and balance can involve the use of the resistance band. A number of exemplary exercises are provided below. Typically, the base is removed for the exercises. However, by including the base, balance training can be incorporated into the process.

To work the back, the following exercises are performed using a resistance band and looping it through the appropriate notches on the platform. Because this move uses only one end of the band, the other end of the band can be immobilized with the other hand or the band can be held under the platform when the base is not in use. For example, a single arm row can be performed without the base, with the base and with two legs on the platform, or with the base and with a single leg on the platform and one leg off of the platform.

A dead lift can be performed with one arm or two arms without the base. Alternatively, when using the base, a dead lift can be performed with two arms and both legs on the platform; one arm and both legs on the platform, one leg on the platform and two arms, or one leg on the platform and one arm.

The shoulders are worked using the resistance band by doing a shoulder press without the base with one or with two arms. Or alternatively, the base can be used with both legs on the platform or with one leg on the platform with one or both arms. A shoulder lateral raise can be performed as with the shoulder press as can a front raise.

The triceps can be worked using the resistance band with a triceps kick-back using the variety of stances with the base on or off as in the shoulder exercises. Alternatively, an over-head elbow extension can be used with the base on or off using the same stances and with one arm or two.

The Biceps are worked using the resistance band in the appropriate notches and can also be performed with or without the base and with a single arm or both arms. The additional use of the base increases the difficulty and can be using both legs or a single leg on the platform and one leg off.

Push-ups can be performed prone in a wide variety of ways using the device and do not require the use of the resistance band. They can be performed using the hand-holds positions at 180 degrees, at 90 degrees or in any other positions as desired. The push-ups can also be performed with the forearms on the platform. Further, the push-ups can be performed on the knees or on the toes as desired. The push ups can be performed with the arms at the classical position of being perpendicular to the body, or the device can be rotated to any angle desired, creating an uneven pressure on the arms.

Example 3

Use of the exercise device for lower body strength and balance typically involves using the base to increase the difficulty. However, the same types of exercises can be performed without the base and using the resistance bands. For the quadriceps, for example, a squat can be performed with the feet contacting the platform. This can be done using a base and including balancing or can be done with the base removed and using a resistance band for added resistance. Alternatively, the squat can be performed with a single leg on the platform including a base and the other leg is on the support surface. Lunges can be performed with one foot on platform and one foot off, or can be performed without the base and using the resistance band for added resistance.

The hamstrings can be worked by doing a stiff leg dead lift with a single leg on the platform, using a base or with two legs on the platform. The resistance band can be used to add resistance. When the resistance band is used an alternative is to remove the base and use it to stabilize the resistance band.

Example 4

Use of the Exercise Device for Lower Body Strength and Balance

Abdominal and/or Core exercises can be performed as follows: Spinal rotations use the resistance band and involve standing on the platform with or without the base and doing a woodchop motion with the resistance band. For example, the user squats, extends across the body with the arm or arms and rotates engaging the muscles of the core. An iso-prone bridge can be performed with the base either face down with forearms on platform or face down with feet on platform. An isometric Plank can be performed in a push up position either face down with forearms on platform or face down with feet on platform. In addition, the plank can be performed including a rotation to put the body off-balance.

Using the track ball, roll out can be performed from knees and can be directly forward and back or can be rolled at an angle to put the body off-balance.

Example 5

Kit for Home Use of the Exercise Device

The kit comes equipped with the device of Example 1 and a book, user's manual or any form of written material that includes instructions about generally how to use the device, for example, how to remove the bases. Further, a number of exercises are described for different regions of the body as well as safety information and an exemplary 5-20 minute workout. A further 20 and 40 minute workout can be sold separately or included within the kit In addition, a video and/or audio tape (or any format) providing a workout can be included or sold separately.

The various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments. Similarly, the various features and steps discussed above, as well as other known equivalents for each such feature or step, can be mixed and matched by one of ordinary skill in this art to perform methods in accordance with principles described herein.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein, but instead by reference to claims attached hereto.

What is claimed is:

1. An exercise device, comprising:

a platform having an upper surface, a lower surface, and a perimeter edge, wherein the platform as a whole is generally oriented along a plane;

a roller unit attached to the platform, the roller unit including a roller below and configured to rotate with respect to the platform, the roller located within the perimeter edge of the platform;

a pair of arms extending outward at generally opposing portions of the perimeter edge of the platform, each arm comprising a length adjustment mechanism for linearly extending an outer portion of the arm with respect to an inner portion of the arm, the inner portion of the arm being connected to the platform; and two handle units, each handle unit being connected to a different one of the arm outer portions, each handle unit including a handle whose position can be adjusted relative to the arm outer portion to which the handle unit is connected;

wherein a user can grasp each handle while contacting the roller lower surface against a support surface such that the roller supports an upper body weight of the user.

2. The exercise device of claim 1, wherein said roller unit is modularly attachable to said platform.

3. The exercise device of claim 1, wherein said roller unit comprises a generally hemispheric base attached to said platform, the roller being attached to the base.

4. The exercise device of claim 1, wherein said roller is positioned at a center of the lower surface of the platform.

5. The exercise device of claim 1, wherein said inner portions of the arms are integral with said platform.

6. The exercise device of claim 1, wherein said arms are modularly attachable to said platform.

7. The exercise device of claim 1, wherein said arms are substantially collinear.

8. The exercise device of claim 7, wherein said adjustment of the handles' positions comprises rotation of each handle relative to both the platform and the arm outer portion to which the handle unit of the handle is connected.

9. The exercise device of claim 8, wherein said rotation is permitted through at least 360 degrees.

10. The device of claim 8, wherein said rotation is substantially without resistance.

11. The exercise device of claim 8, wherein said rotation of the handle relative to the platform comprises rotation of the handle about an axis oriented generally transverse to the platform.

12. The exercise device of claim 1, further comprising at least one notch on a perimeter edge of the platform, the notch defining a pathway generally transverse to a plane of the platform, the pathway configured to receive a portion of a band oriented substantially transverse to the platform.

13. The exercise device of claim 1, further comprising at least one removable strength band attached to the platform, the strength band adapted to be grasped by a user during usage of the exercise device.

14. The exercise device of claim 13, wherein said band is one of at least two removable strength bands of at least two resistances.

15. The device of claim 13, wherein said strength band further comprises a means for length adjustment.

16. The device of claim 13, wherein the at least one strength band is configured to be inserted into at least one notch on a perimeter edge of the platform, the notch defining a pathway for receiving a portion of the band, the pathway being substantially perpendicular to the platform.

17. The exercise device of claim 1, wherein said platform is composed of a substantially inflexible material.

18. The exercise device of claim 1, wherein the roller is configured to rotate in two dimensions with respect to the lower surface of the platform.

19. The exercise device of claim 1, wherein the lower surface of the platform is substantially flat.

20. The exercise device of claim 19, wherein the upper surface of the platform is substantially flat.

* * * * *

UNITED STATES PATENT AND TRADEMARK OFFICE

CERTIFICATE OF CORRECTION

PATENT NO. : 7,658,700 B2
APPLICATION NO. : 10/915126
DATED : February 9, 2010
INVENTOR(S) : Maloy et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 182 days.

Signed and Sealed this

Fifth Day of October, 2010

David J. Kappos

David J. Kappos
*Director of the United States Patent and Trademark Office*